United States Patent [19]

Labombarde, deceased

[11] Patent Number: 4,961,566

[45] Date of Patent: Oct. 9, 1990

[54] APPARATUS FOR FEEDING SHEETS FROM A STACK OF SHEETS

[75] Inventor: Raymond A. Labombarde, deceased, late of Nashua, N.H., by Ruth N. Labombarde; Nashua Trust Company, executors, both of Nashua, N.H.

[73] Assignee: International Paper Box Machine Co., Inc., Hillsborough, N.H.

[21] Appl. No.: 931,406

[22] Filed: Nov. 14, 1986

[51] Int. Cl.[5] ..... B65H 3/04

[52] U.S. Cl. ..... 271/35; 271/124; 271/2; 271/167; 414/797.6

[58] Field of Search ..... 271/2, 10, 34, 35, 121, 271/124, 125, 167, 256; 414/125, 129, 130

[56] References Cited

U.S. PATENT DOCUMENTS

| | | | |
|---|---|---|---|
| 3,406,963 | 10/1968 | Goss | 271/35 |
| 3,612,512 | 10/1971 | Long | 271/35 |
| 3,740,031 | 6/1973 | Scully | 271/35 |
| 4,034,976 | 7/1977 | Lundblad | 271/35 X |
| 4,200,033 | 4/1980 | Labombarde | 271/35 X |
| 4,494,745 | 1/1985 | Ward, Sr. et al. | 271/35 X |

*Primary Examiner*—Joseph J. Rolla

*Attorney, Agent, or Firm*—Pearson & Pearson

[57] ABSTRACT

An apparatus for selectively feeding sheets from a stack of sheets in sequence along a paper line, has an endless carrier belt which advances the sheets individually and successively through a feeding zone. A vertically actuated feed gate operates between two opening positions to allow only the lowermost sheet in the stack to advance sequentially through each opening position and the opening of both positions is controlled. A stack lifter moves sequentially in a vertical path above and below the carrier belt so that the lowermost sheet advances when in contact with the carrier belt to advance a portion of the lowermost sheet in the stack through the first opening position. The apparatus also forms a second predetermined opening portion between the lifter and feed gate which moves the gripper surface through which the remaining portion of the sheet advances.

16 Claims, 8 Drawing Sheets

10
70
22
63
69
79
64
72
80
65
21
74
22
87
66
23
30
29
24
67
71
31
28
25
75
40
40
36A
27
35
33
41
39
48
78
32
67
26

10
11
70
22
72
23
30
35
71
75
40
40
34
36
25
27
33
41
45
45a
11
36A
76
48

*Fig.5.*
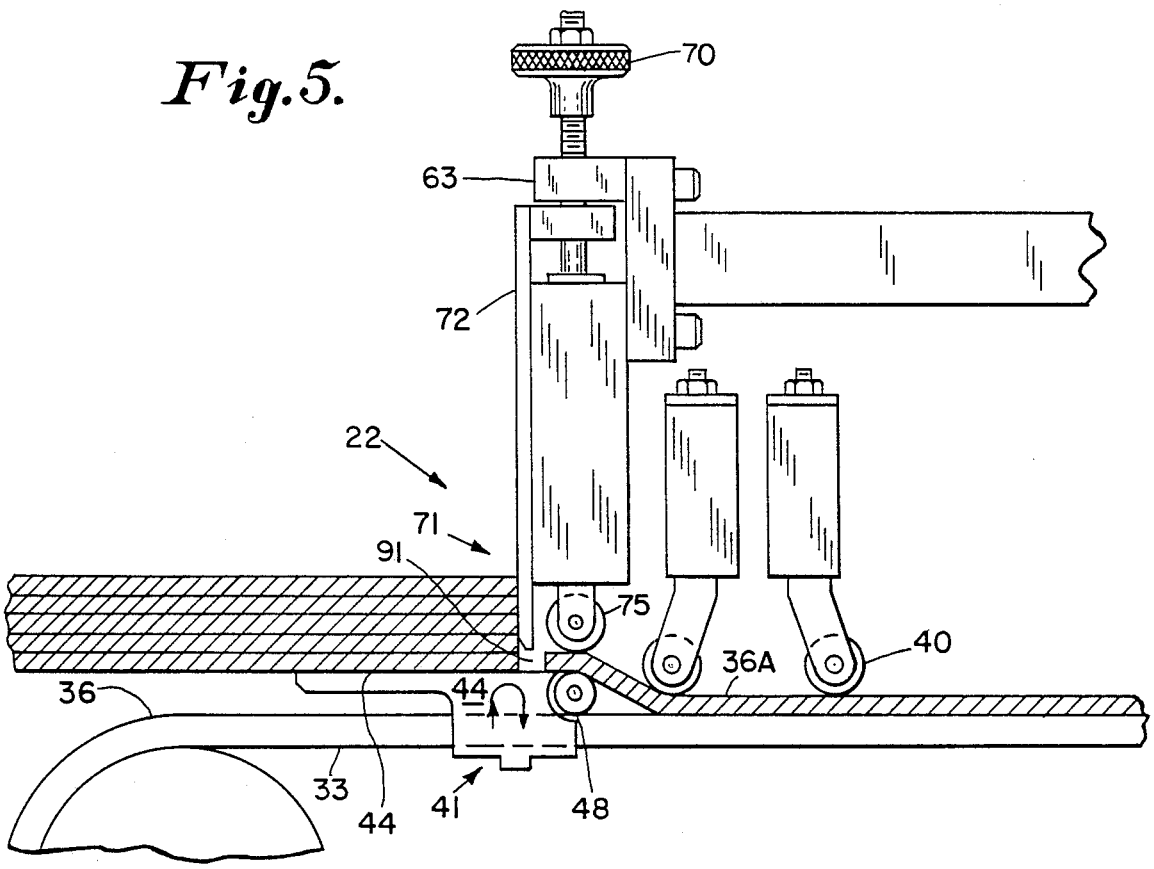
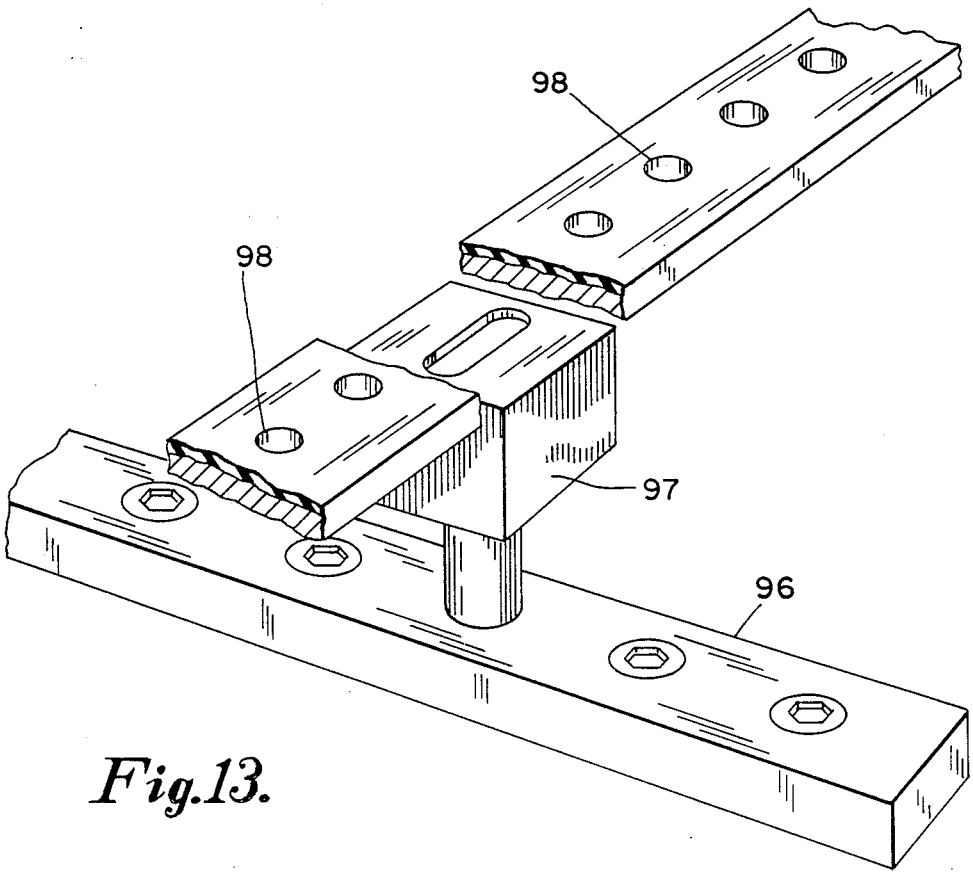
*Fig.13.*

72
71
28
44
46
75
39
40
41
60
56
58
57
88
55
51
59
54
52
61
62
53
95
94
55
99
93
51
100
101
61
54
52
59
53

APPARATUS FOR FEEDING SHEETS FROM A STACK OF SHEETS

BACKGROUND OF THE INVENTION

In the folding paper box machine art, sheet feeders are well known, and it has heretofore been proposed to use feed control apparatus, also known as "bumper" type feeds, in the feeding zone for assuring that only the lowermost blank in a stack of identical flat box blanks will be advanced through the gateway of the magazine and along the horizontal paper line of the machine.

One type of box blank feed is disclosed in U.S. Pat. No. 4,200,033 to Raymond A. Labombarde of Apr. 29, 1980 which has a mechanically actuated timed bumper type magazine feed which feeds flat box blanks onto an untimed conveyor in a flap feeding zone. This bumper feed has elongated lifter bars mounted in the space between feed belts which are raised and lowered to control the feed of each successive lowermost blank out of the gateway at the bottom of the stack.

In another type of bumper feed disclosed in U.S. Pat. No. 3,612,512 to Lang of Oct. 12, 1971, the lifting member is between the carrier belts and differs from applicant's structure because it is in pivotal cooperation with the blanks.

This structure presents a problem for high speed feeding in that as the lifter is lifted upwardly, it may cause friction between the gate and the lift plates acting on the trailing end of the carton being fed, and cause some hesitation or marking on the carton, and therefore, the dwell period of the lifting has to be accurately timed by means of a cam to suit each length of carton being fed.

This feed is not capable of running paper or thin material, as compared to regular boxboard, nor is it suitable for cartons or paper that has a high quotient of friction, as the friction between the sheets tends to pull the second sheet into the nip.

Furthermore, this feed is therefore sensitive to the pile height in the feed hopper, whereas applicant's new feed overcomes this difficulty.

Another type of bumper feed is disclosed in U.S. Pat. No. 3,406,963 to Goss of Oct. 22, 1968, wherein the upper reaches of a plurality of endless carrier belts advance under the lower surface of the lowermost blank in a stack and are liftable into contact with that surface to advance the lowermost blank by means of cams.

The applicant's invention has many advantages over the prior art "bumper" type feed apparatus including the following advantages.

Because the feed nip between the feed belt and gate is completely isolated from the stack of sheets during the nonfeeding portions of the feed cycle, the next blank is prevented from creeping into the feed out of time.

Some sheets are difficult to feed because of the high coefficient of friction between the sheets and, therefore it is advantageous to have the feed stack at a high angle to allow the traveling portion of the sheet being fed to fall free from the rest of the stack to reduce frictional drag. This is the only "bump" feed that can be used in this manner since a high angle on all other bump feeds will cause false synchronization feeding, due to the proximity of the leading edge of the lowermost sheet to the "nip point".

When attempting to feed thin sheets such as paper (such as 0.003 inch thick) on a standard bottom feed it is particularly difficult and often impossible to prevent the second sheet from being urged forwardly as soon as any gripper surface touches the sheets prior to the first sheet leaving the feed gate.

When this happens some sheets tend to wrinkle thereby causing a jam. With this new feed, however, forwardly urging or jamming of the next sheet being pre-fed by the gripper face is eliminated since the stack lifter means lifts the stack away from the gripper surface sufficiently in advance, to eliminate possible contact of the second sheet with the gripper surface, while the first sheet is being fed.

The lifting of all or at least the front end of the stack during the "no feed" cycle and allowing the stack to engage the gripper surface at the maximum descending speed of the eccentric increases the effectiveness of the "gripper surface" to advance the blank at precisely the correct moment. This "slamming down" of the stack onto the feed belt at the feed nip position is only possible using this invention, and therefore, an effective contribution to steady, high speed productive feeding.

SUMMARY OF THE INVENTION

This invention is directed to an apparatus for handling sheet material such as box blanks, but more particularly for handling various thicknesses of sheet materials such as extremely thin sheet material, namely envelopes.

Presently it is almost impossible to run various thicknesses of sheets through sheet feeders since they are sometimes too fragile. Sheets such as envelopes have no integrity and tend to crumple in the feeding section of the sheet feeder machine because the tail end of the first sheet causes friction against the second sheet, thus causing a jam.

Blanks and the like with the thickness of envelopes are known as the "scourge" of the sheet feeder machines because of the tendency to crumple in the feeding section and thereby jamming the machine.

In this invention, an apparatus for selectively feeding sheets is designed to have a forwardly driven endless carrier belt which advances any sheets coming in contact therewith individually and successively along a paper line in a sheet feeding zone. A vertically actuated feed gate is operable between two positions and allows only the lowermost sheet to advance through the opening positions.

A stack lifter means moves in a vertical path above and below the paper line and lifts the stacks of sheets onto and off of the gripper surface of the carrier belt so that the lowermost sheet engages the gripper surface when the stack lifter means is moved below the gripper surface thereby advancing a portion of the lowermost sheet through a first opening position.

The remaining portion of the sheet advances through a second predetermined opening position when the lifter means and feed gate move above the gripper surface.

BRIEF DESCRIPTION OF THE DRAWINGS

Other objects, features and advantages of the invention will be readily apparent from the following description of certain preferred embodiments thereof, taken in conjunction with the accompanying drawings, although variations and modifications may be effected without departing from the spirit and scope of the novel concepts of the disclosure, and in which:

FIG. 5 is a side elevational view showing the trailing edge of the sheet advancing through the second opening and through the gate means;

FIG. 13 is a prospective view of the synchronized stationary vacuum means.

DETAILED DESCRIPTION OF THE DRAWINGS

Figure 1:
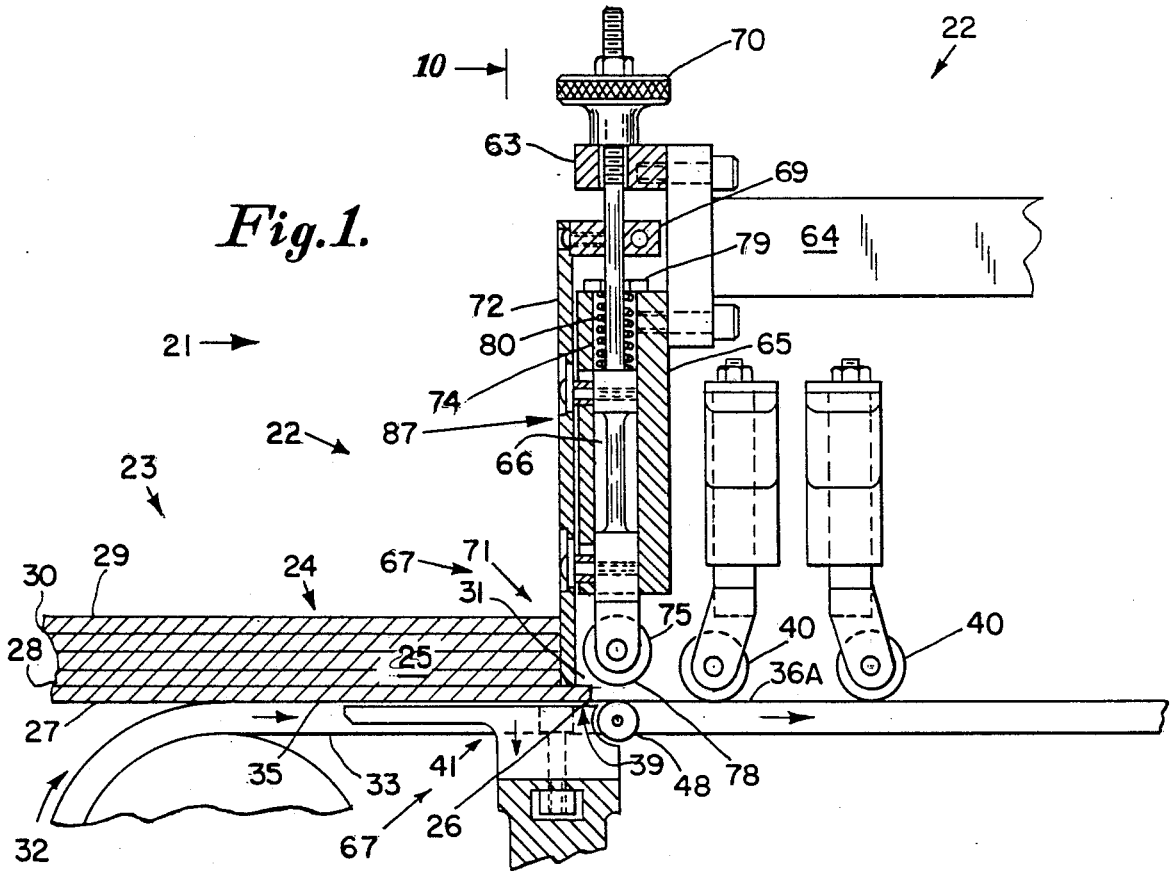
FIG. 1 is a side elevational view of the feeding zone of the apparatus as the sheet material enters the gate means.

FIG. 1 is a side elevational view of the feeding zone of the apparatus showing the stack lifter means on the downward stroke. The upper surface of said lifter means, having just passed below the gripper surface (36) of the upper reach 36*a* of the forwardly driven endless carrier belt (33) causing the lowermost sheet from the stack of sheets to advance forwardly into the primary "feed nip" position (39) through gateway 31.

Figure 2:
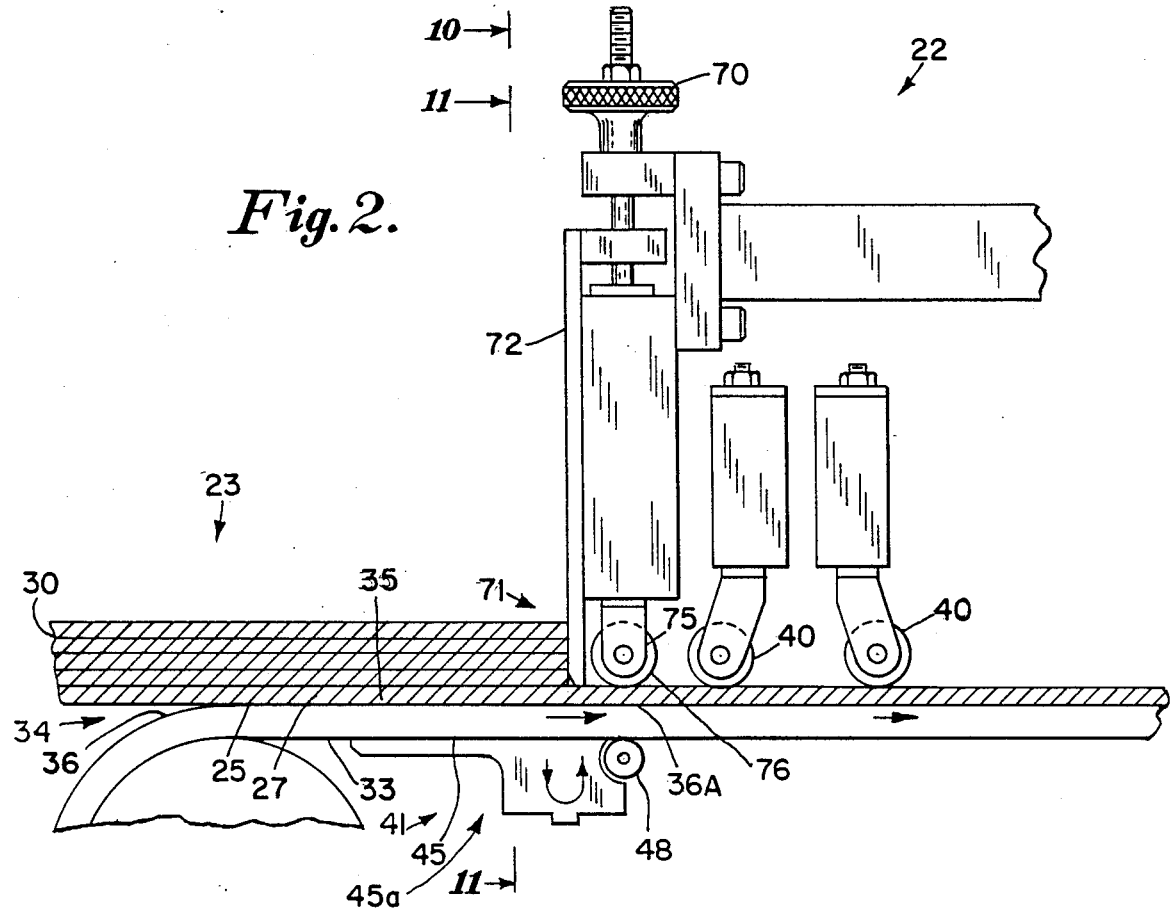
FIG. 2 is a side elevational view of the feeding zone with the upper surface of the stack lifter means partially below the gripper surface of the belt.

FIG. 2 is a side elevational view of the feeding zone with the stack lifter means below the paper line at its lowest point about to reverse its direction upwardly. The view illustrates the leading edge of the fed blank to be now engaged by not only the "feed nip" position (39) at the gripper surface (33), but also by the nip of the feed pull rolls (40).

Figure 3:
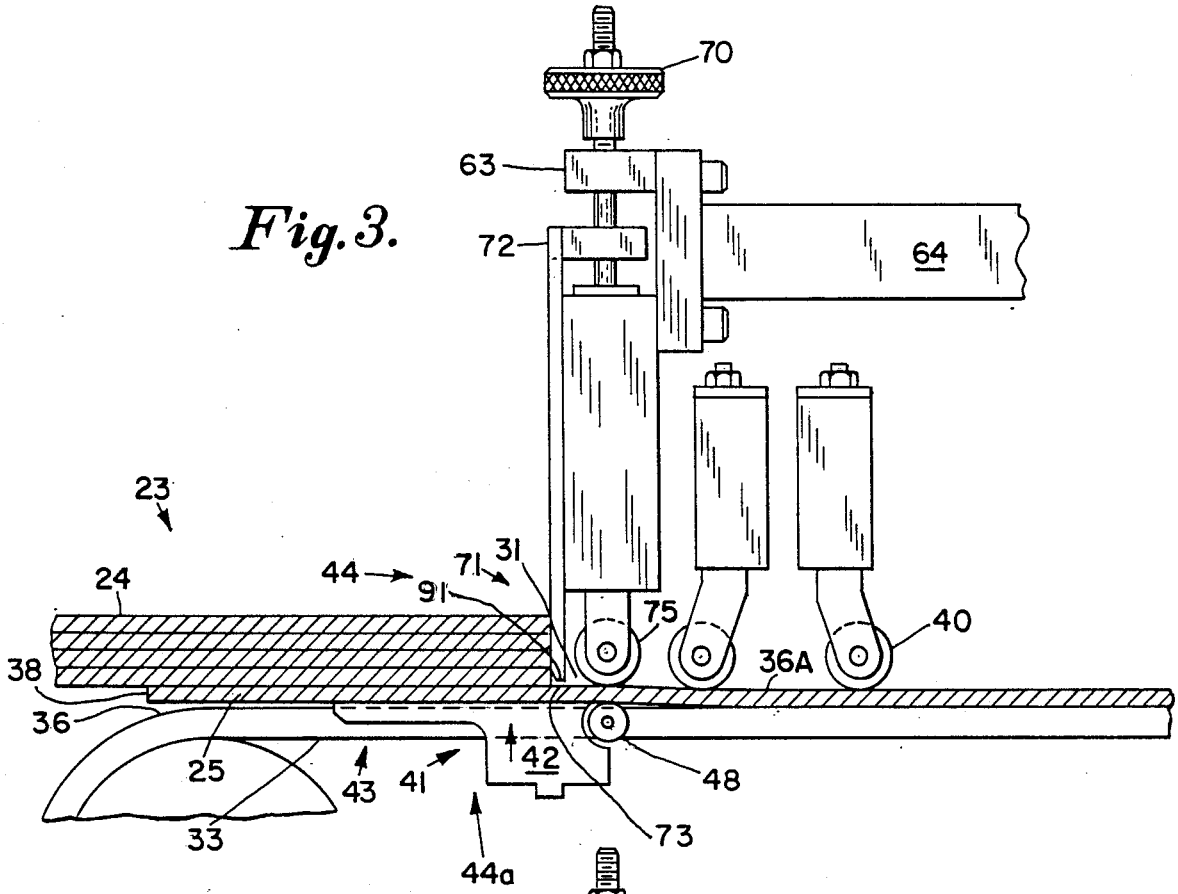
FIG. 3 is a side elevational view of the feeding zone with the gate means at a predetermined height and the lifter means above the paper line and traveling vertically and parallel to the lengths of sheet material.

FIG. 3 is a side elevational view of the feed zone with the upper surface of the stack lifter means (41) just rising above the gripper surface (36) forming "the secondary gate opening" (91) between the stack lifter means and the feed gate.

Figure 4:
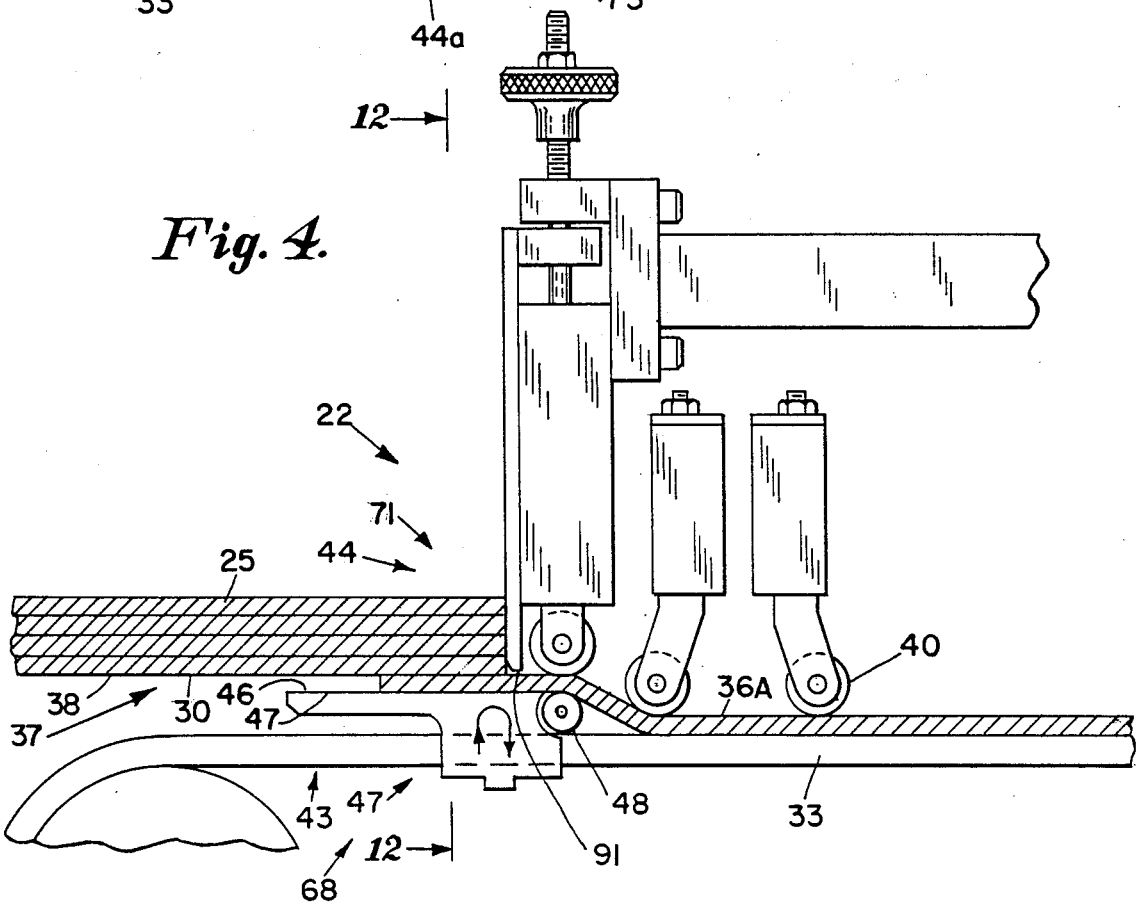
FIG. 4 is a side elevational view of the lifter means supporting the sheet material above the paper line.

FIG. 4 is a side elevational view of the stack lifter means supporting the sheet material at its highest point above gripper surface about to reverse its direction downwardly. The view illustrates the trailing edge of the fed carton just about to leave the secondary gate opening (91).

FIG. 5 is a side elevational view showing the trailing edge of the sheet as it advances through the secondary gate opening (91) and through roller bearing (75) attached to adjustable gate means (71), cooperating with the lifter bar roller bearing (48) attached to lifter bar means (41) directly positioned beneath feed gate roller bearing (75) which forms the secondary gate opening (91) at the time the sheet is pinched between these rollers as the lifter bar rises above the gripper surface, and maintains this gate opening so long as a sheet is pinched between rollers (75) and (48).

Figures 6, 6A:
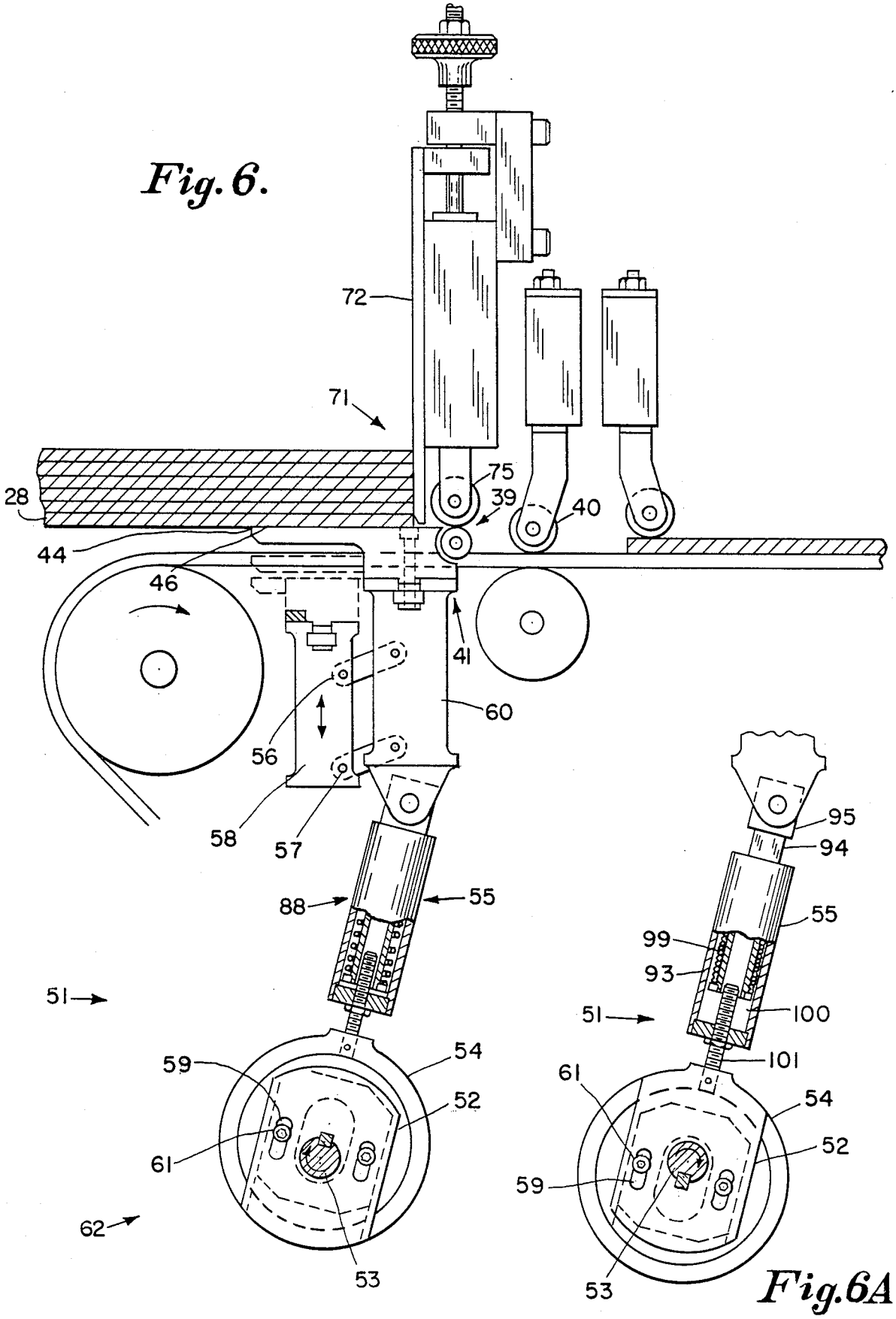
FIG. 6 is a side elevational view of the feeding zone in the stop feed position.
FIG. 6A is a side elevational view of the spring loaded turnbuckle assembly.

FIG. 6 is a side elevational view of the feeding zone in the stop feed position wherein the lifter bar means (41) is in the top dead center position of the drive means when a rotatable variable eccentric (52) rotated by the eccentric drive shaft (53) and mounted within a yoke (54) to vertically lift and lower the turnbuckle adjustment assembly (55) and the stack lifter support bar (60). The stack lifter support bar (60) is guided on at least two pairs of parallel links (56) and (57) which are pivoted on a cross bar (58).

FIG. 6A is a side elevational view of the spring loaded turnbuckle assembly (55) shown fully extended as the rotating drive shaft turns the eccentric to the bottom dead center position. The turnbuckle assembly 55 has an outer sleeve 93, a hollow spring-return turnbuckle stem 94, a clevis pivot 95, a spring 99, a threaded collar 100, and a threaded stem 101.

Figure 7:
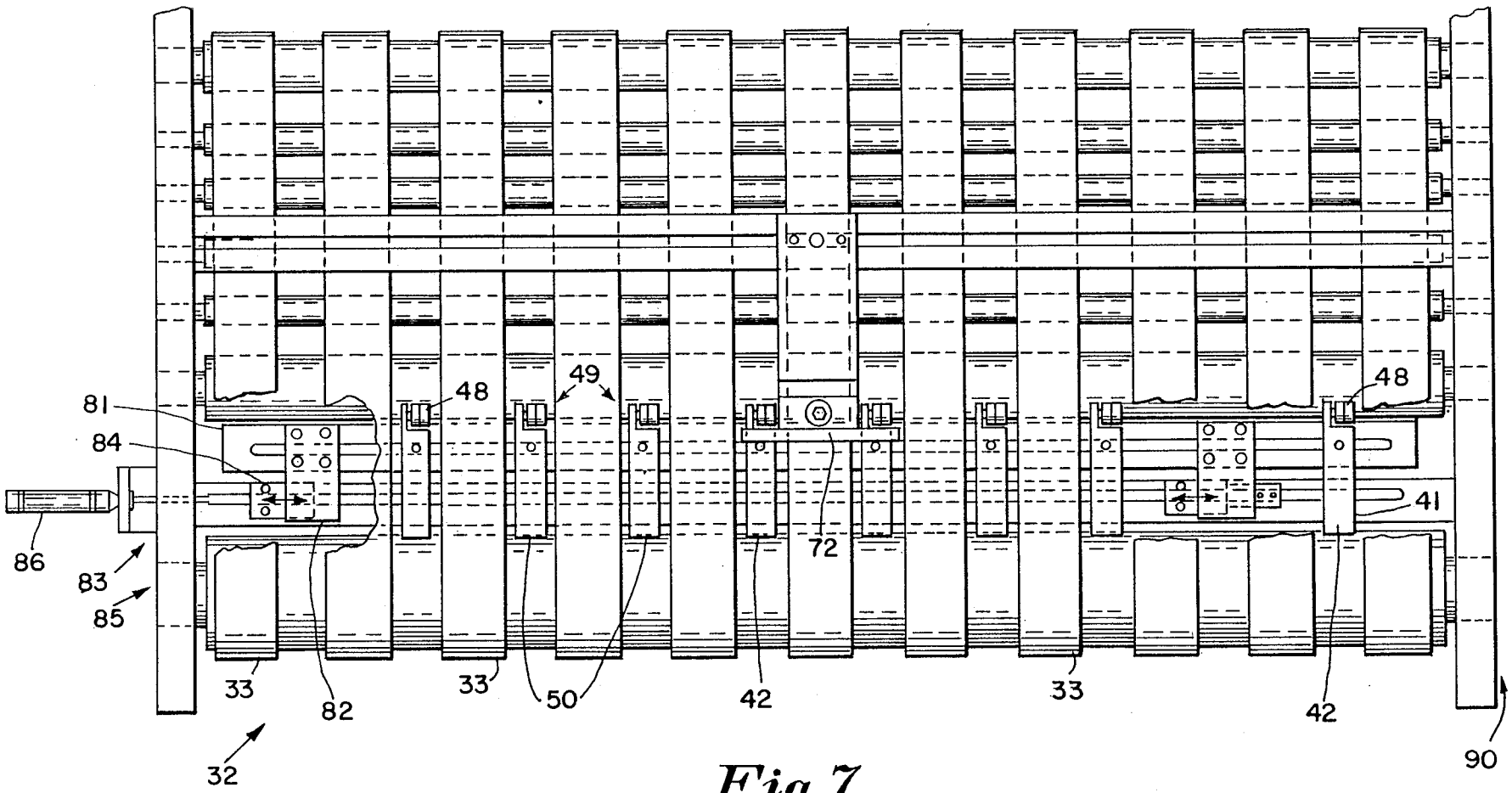
FIG. 7 is a top plan view partly cut away with parts deleted for clarity showing the locking wedge.

FIG. 7 is a top plan view partly cut away with parts deleted for clarity showing the locking wedges (84) engaged under wedge receiving plate (82) attached to wedge bar (81).

Figure 8:
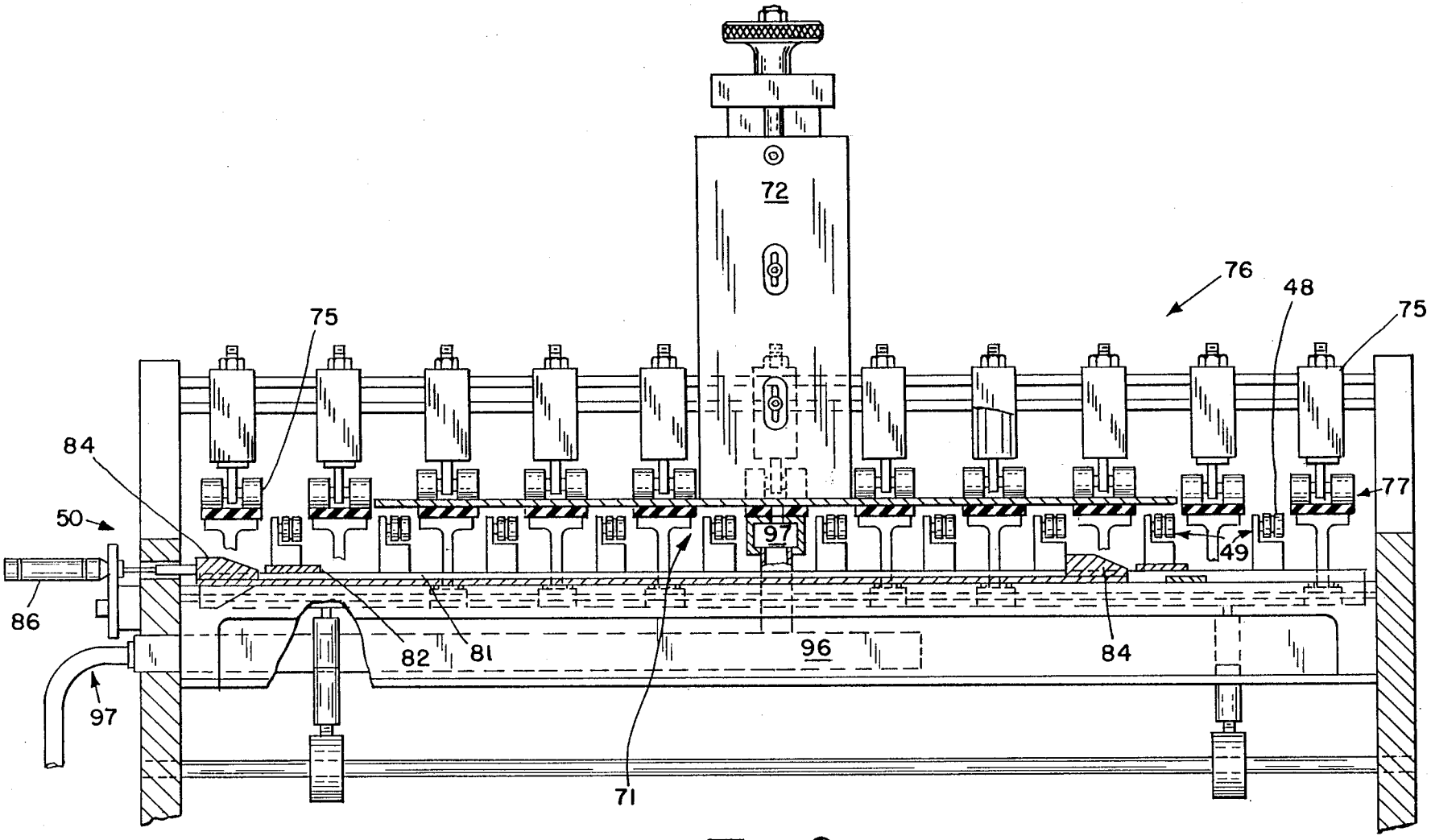
FIG. 8 is a front plan view partly cut away showing the locking wedge in disengaged position.

FIG. 8 is a front plan view partly cut away showing the locking wedges (84) in disengaged position allowing the lifter means (41) to descend below the gripper surface (36) during the feed cycle and the vacuum chamber (96) attached to synchronized vacuum means (97) in engaged position and mounted below the upper reach of the carrier belt.

Figure 9:
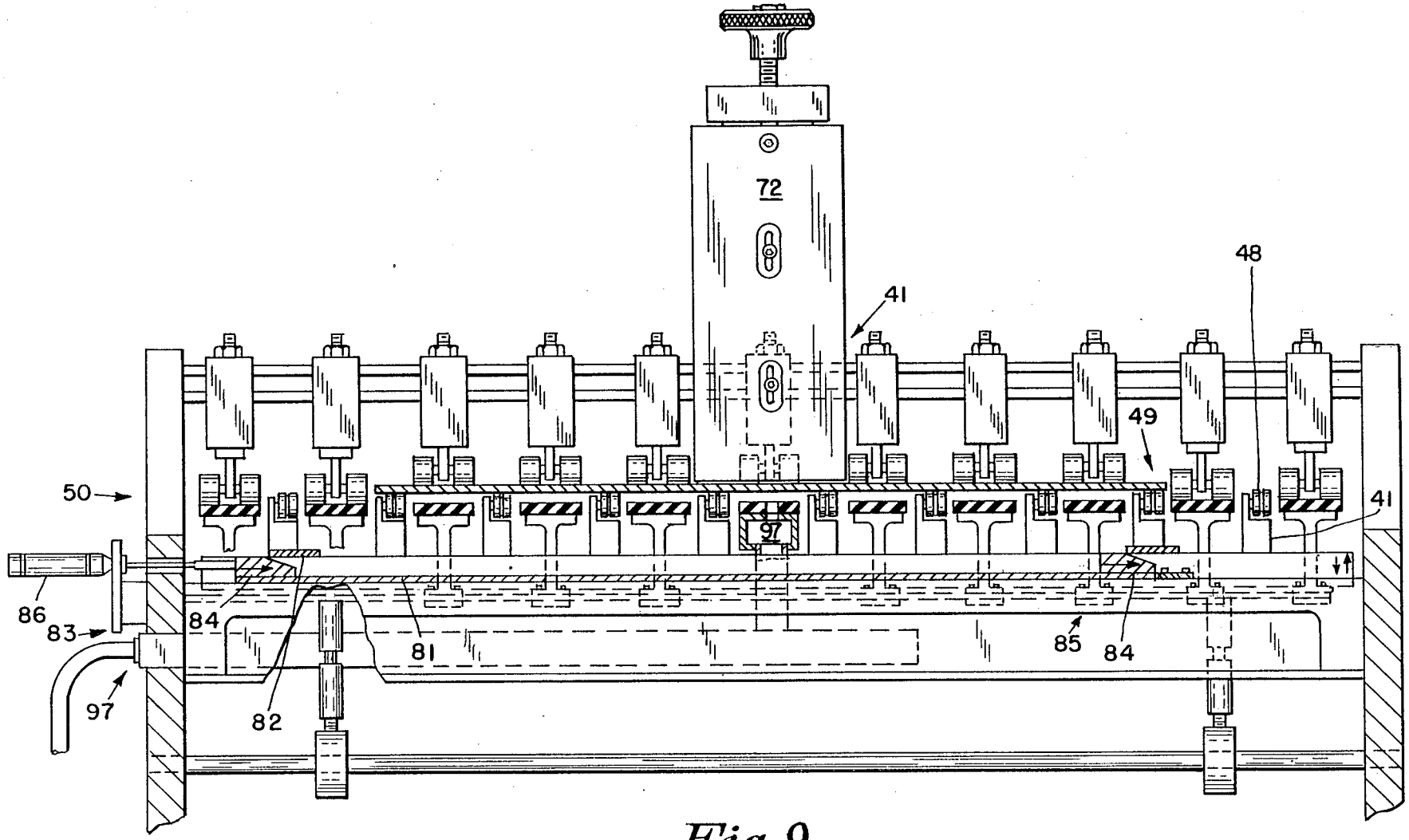
FIG. 9 is a front plan view partly cut away showing the locking wedge in locking position.

FIG. 9 is a front plan view partly cut away showing the locking wedges (84) in locking position and the lifter means (41) held above the gripper surfaces (36) of the upper reaches of the conveyor belts, and the synchronized vacuum means 97 in disengaged position.

Figure 10:
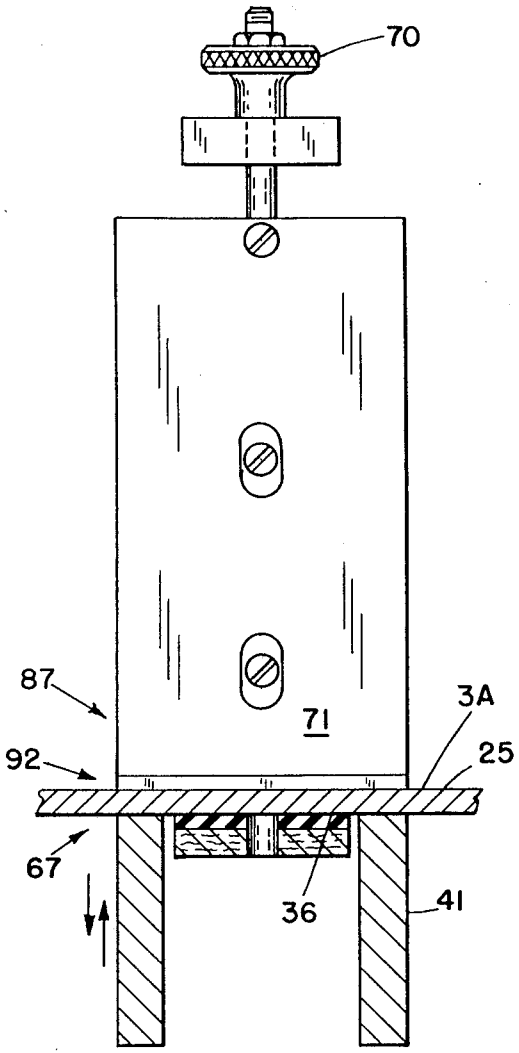
FIG. 10 is a front elevational sectional view along lines 10—10 of FIG. 1.

FIG. 10 is a front elevational sectional view taken along lines 10—10 of FIG. 1 showing the upper stretch of the belt (36) advancing the sheet (25) through the adjustable gate means (71) along the stack lifter means (41).

Figure 11:
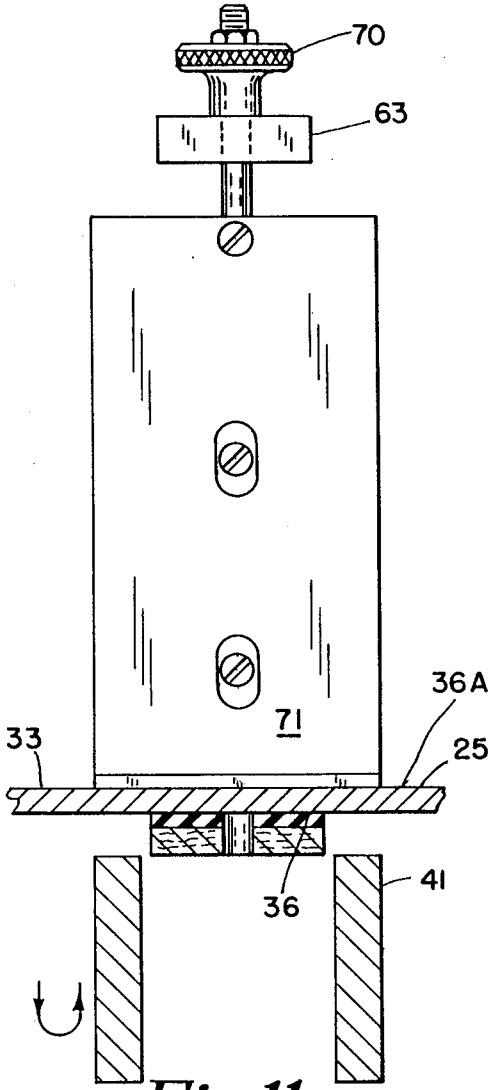
FIG. 11 is a front elevational sectional view along lines 11 of FIG. 2.

FIG. 11 is a front elevational sectional view taken along lines 11—11 of FIG. 2 showing the sheet(25)being advanced along the upper reach 36*a* of the belt(33)-through the adjustable gate means (71) wherein the stack lifter means (41) is below the gripper surface of the belt.

Figure 12:
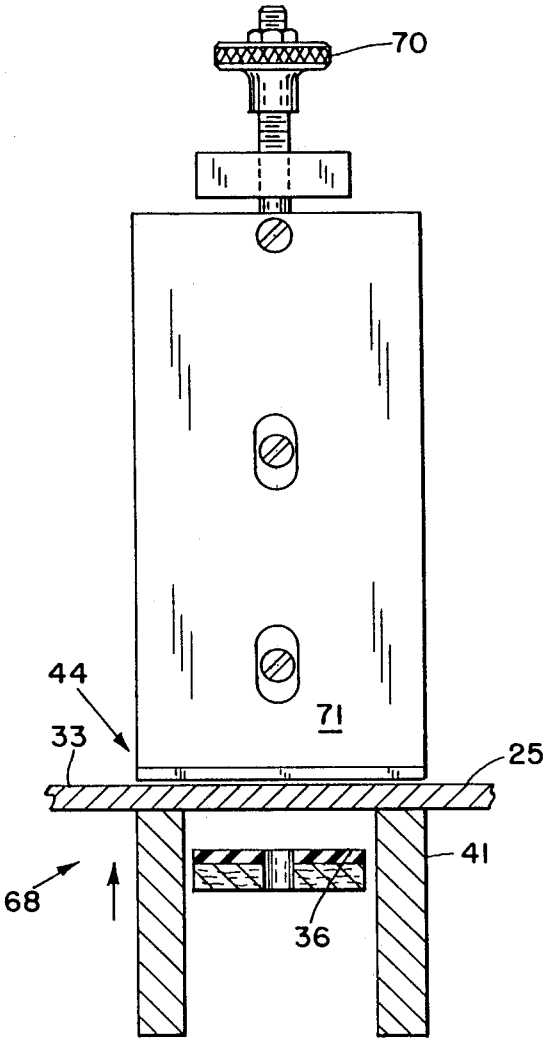
FIG. 12 is a front elevational sectional view along lines 12—12 of FIG. 4.

FIG. 12 is a front elevational sectional view taken along lines 12—12 of FIG. 4 wherein the stack lifter means (41) is supporting the sheets (25) above the gripper surface 36 of the belt (33).

FIG. 13 is a prospective view of the synchronized stationary vacuum means (97) having a plurality of suction apertures (98).

DESCRIPTION OF THE PREFERRED EMBODIMENT

As shown in the drawings, an apparatus 21 for selectively feeding individual sheets 25 in timed sequence for further processing has a box blank or sheet feeding zone 22.

In the feeding zone 22 there is a bottom feed magazine 23 which supports a stack 24 of carton blanks, sheet material or envelopes 25, the leading edge 26 of the lowermost blank or sheet 27 being opposite the gateway 31 which permits passage of only one blank 25 at a time, through a feed nip position 39. Each blank 25 having a thickness 28 of predetermined size and an upper surface 29 and a bottom surface 30.

The apparatus for feeding sheet material 21 including a plurality 32 of laterally spaced, endless carrier belts 33, is best seen in FIGS. 1–4 and 7.

The upper surface of the upper reach 36*a* of the conveyor belt constitutes the paper line 35 or travel plane of the sheets.

The path 34 of the carrier belts is below the paper line 35, and each carrier belt has a gripper surface 36 with an upper reach 36*a* which is parallel 37 to the paper line and may be parallel to the lengths 38 of the sheet material 25. The gripper surface 36 has a high coefficiency of friction and advances the said sheet material individually and successively along the upper reach 36*a* of the belts through the sheet feeding zone.

An oscillating feed gates means 71 may include a support block 63 attached to a support bar 64, a vertical rectangular sleeve 65 which is also attached to the support bar. The sleeve broached square provides an internal slide surface for matching non-rotable square slides provided on a vertically oscillating stem 66.

The oscillating gate means includes a vertical actuated feed gate 72 which is operably connected to the oscillating stem 66 which is adjusted by adjustment means 70 to a nip thickness 28 of slightly less than the sheet material 25 to be fed into the apparatus. The oscillating gate means which may be spring loaded 74 is adjusted to a predetermined height 73 above the feed carrier belts to allow only one-half length of sheet material at a time to advance individually and successively through the feed nip position 39 along the path 34, through the feeding zone. The feed gate 72 may be wider than the belt, and thereby forms at least one second opening adjacent to the carrier belts.

Roller bearings 75 are fastened to the base of the oscillating stem 66 of the oscillating gate means to roll freely in the direction of the sheet feed, and at least one pull roller 40 is attached beyond the feed gate to advance the sheet through the feed zone when off the gripper surface.

The vertically actuated feed gate is operable between a first opening position 67 as best seen in FIG. 1 and 10, and a second opening position 68 as best seen in FIGS. 4 and 12 to allow only the lowermost sheet 27 to advance through the opening positions.

The secondary opening position is set and locked by stem clamping block 69 which is fastened to feed gate 72 to provide a vertical gate position clamp lock of the feed gate 72 and stem 66 to secure the proper adjustment of the feed gate with respect to the bottom 78 of roller bearing 75.

A spring cap 79 is fastened to the top of sleeve 65 which comprises the feed gate spring 80 into operational place. A feed gate adjusting means 70 adjusts support block 63 to provide a primary feed nip position 39 at the gate over the belt at the time when the lifter bar means descends below and continues to remain below the gripper surface of the belt.

A means 87 for controlling height or the gap forms a predetermined opening including a first opening position 67 which forms a nip inch position which is between the feed gate 72 and the gripper surface of the carrying belt. The means 87 could be the adjustable gate means 71.

Another means 88 controls the height or gap of the second opening position 68 which forms a gate open position between the feed gate 72 and the stack lifter means. This means 88 could be a turnbuckle adjustable assembly 55.

A stack lifter means 41 may comprise at least one elongated stack lifter bar 42, or a plurality of lifter bars 50, located between a plurality of carrier belts 33. The stack lifter means 41 is mounted to move sequentially in a vertical path 43 above and below the gripper surface to lift and lower the stack of sheets onto and out of engagement with the gripper surface so that the lowermost sheet 27 engages the gripper surface when the stack lifter means is moved below the gripper surface to advance a portion of the lowermost sheet through the first opening position 67.

The stack lifter bars 50 have a flat surface which is parallel to the paper line and forms the second opening 68 in the form of a horizontal slot 92, as best seen in FIG. 10, wherein the slot has a height which is greater than one sheet, but less than two sheets.

A means 44 as seen in FIGS. 3, 4, and 12 forms a second predetermined opening 68, when the lifter means and the feed gate move above the gripper surface through which the remaining portion of the sheet advances.

The stack lifter means 41 lifts or lowers the lengths of sheet material into a first position 45*a*, out of engagement 45 with the upper reach 36 of the carrier belts 33. When the stack lifter means 41 is out of engagement 45 of the sheet material, each successive lowermost sheet 27 engages the carrier belts 33 which advances the sheet material through the feeding zone 22. The stack lifter means can move in a vertical path above and below the paper line in a range to accommodate any thickness of sheet material.

The stack lifter means may be a lifter bar 42, or may be a plurality 90 of lifter bars which are located between adjacent carrier belts and may lift the stack in a plane parallel 37 to the paper line.

The upper surface 46 of the stack lifter means 41 includes a means 47 to reduce the friction between the upper surface of the lifter means and the bottom surface 30 of the sheet material. As shown best in FIGS. 7–9 the means to reduce friction may be a single roller 48, or may be a plurality of rollers 49 in the upper surface 46 of each lifter bar 42.

A feed control means 51 as best seen in FIGS. 6 and 6*a* comprising a rotatable variable eccentric 52 rotated by a shaft 53 and mounted within a yoke 54 to vertically lift and lower a turnbuckle adjustment assembly 55 and the stack lifter means 41. To synchronize the same with the cycle of the apparatus the stack lifter means 41 is guided on a pair of parallel links 56 and 57 which are pivoted to a cross bar 58.

The turnbuckle adjustment assembly 55 is in the top Dead Center Position in FIG. 6 and may be spring loaded and permits variation in the limit, or length of travel of the stack lifter means 41 in accordance with the variable throw of the eccentric 52. The throw of the eccentric is variable by means of the slots 59, bolts 61 in the yoke 54. The throw of the eccentric is adjustable to conform to the length of the sheets 38 being fed along the paper line of the machine.

Also shown in FIG. 6, is a drive means 62 for rotating the eccentric at a predetermined speed for synchronizing the same with the speed of the carrier belts and turnbuckle 55 which is connected to the stack lifter means 41 and may include, a feed drive shaft 53 of feed control means 51, which is driven by a variable speed drive unit and motor by a timing belt or chain (not shown).

In FIGS. 7, 8, and 9, the stack lifter means includes a wedge bar 81, a wedge receiving plate 82 thereon, and may include a plurality of wedge receiving plates 83. The wedge bar 81 has at least one wedge 84 mounted thereon, but could have a plurality 85 of wedges mounted on the said wedge bar 81 to support the lifter means in locked position at the end of the cycle, or on the high cycle above the paper line thereby supporting the sheet material above the carrier belts, thus stopping the sheet material from advancing through the gate means. The wedge bar 81 and wedge 84 is operated by air cylinder 86.

As best seen in FIGS. 8, 9, and 13, a vacuum chamber 96 is attached to a synchronized vacuum means 97 which is mounted below the upper reach of the carrier belt sequenced to operate and activate when the sheets contact the carrier belt to advance said sheets, which has a plurality of suction apertures.

In practice as shown in FIG. 1 which is the "start" position, the apparatus for feeding sheet material has a bottom feed magazine 23 which is loaded with blanks, sheet material, envelopes, or the like.

The blanks proceed through the gateway 31, because the adjustable gate means is at a predetermined height above the carrier belts and the surface of the stack lifting means is positioned below the top surface of the carrier belts. The eccentric is at the bottom of its stroke at one quarter cycle position which could also be called "starting up" position.

The blank proceeds through the gateway and in FIG. 2 contacts the roller bearings 75, or a plurality of roller bearings 76, which are also at a predetermined height above the top surface of the carrier belts.

In FIG. 3 a length of sheet material proceeds through the feeding zone and the lifter means begins to lift the sheet material in one half cycle position. In FIG. 4 the lifter means is at the top of the eccentric stroke of three quarter cycle position and the stack lifter means has moved in a vertical and parallel direction to the lengths of sheet material above the carrier belts, thereby closing off the predetermined height between the gateway and the carrier belt so that no further blanks can be advanced along the gateway as shown in FIG. 6. This position is also the "stop" feed position and the lifter means is prevented from descending by the wedge.

In FIG. 5 the stack lifter means begins to raise to close the gap between the lifter and the adjustable gate means so that no further blanks will travel therethrough.

FIG. 7 shows the wedges on the wedge bar engaged with the wedge plates, so that the stack lifter means is on the high cycle above the carrier belts and no further lengths of sheet material can proceed in FIG. 7 and FIG. 4. In FIG. 8 the wedge is disengaged from the wedge plate, and therefore, the stack lifter means moves vertically and parallel below the paper line allowing the lengths of sheet material to again proceed through the gateway and the operator (not shown) operates this machine in accordance with the number of blanks required.

I claim:

1. Apparatus for selectively feeding sheets from a stack of sheets in sequence along a paper line through a feeding zone comprising:

at least one forwardly driven endless carrier belt, having an upper reach being parallel to the paper line and having a gripper surface for advancing the sheets individually and sequentially along the paper line;

vertically actuated feed gate operable between a first and second opening position to allow only the lowermost sheet to advance through gaps formed when the gate is in the said opening positions;

means for controlling the gap between the feed gate and the gripper surface of the carrier belt of the first opening position;

means for controlling the gap between the feed gate and the stack lifter means of the second opening position;

stack lifter means which moves sequentially in a vertical path above and below the gripper surface to lift and lower the stack of sheets onto and out of engagement with the gripper surface whereby the lowermost sheet engages the gripper surface when the stack lifter means is moved below the gripper surface to advance a portion of the lowermost sheet through the first opening position; and means to form a second predetermined opening position between the height of the lifter means and feed gate when the said lifter means and feed gate move above the gripper surface through which the remaining portion of the sheet advances.

2. Apparatus for selectively feeding sheets as specified in claim 1 wherein:

the feed gate is wider than the carrier belt, thereby forming at least one second opening adjacent to the said carrier belt.

3. Apparatus for selectively feeding sheets as specified in claim 1 wherein:

the stack lifter means comprises a plurality of lifter bars located between a plurality of carrier belts to lift the stack in a plane parallel to the paper line.

4. Apparatus for selectively feeding sheets as specified in claim 3 wherein:

the stack lifter bars having a flat surface parallel to the paper line, thereby forming the second opening in the form of a horizontal slot having a height greater than one sheet, but less than two sheets.

5. Apparatus for selectively feeding sheets as specified in claim 2 having:

a drive means for rotating an eccentric at a predetermined speed for synchronizing the same with the apparatus; and turnbuckle means connecting said stack lifter means with said eccentric having a variable throw for varying limits of travel of said lifter means in accordance with the variable throw of said eccentric.

6. Apparatus for selectively feeding sheets as specified in claim 1 wherein:

the first opening position forms a nip pinch position and the second position forms a gate open position.

7. Apparatus for selectively feeding sheets as specified in claim 1 having:

a means for controlling the said gap forming a predetermined opening comprising:

a roller attached to the feed gate; and a roller attached to the lifter means in vertical cooperation with each other.

8. Apparatus for selectively feeding sheets as specified in claim 1 wherein:

said lifter means has at least one roller along the surface of the lifter bar to reduce friction.

9. Apparatus for selectively feeding sheets as specified in claim 1 having:

at least one nip pull roller beyond the feed gate to advance the sheets through the feeding zone.

10. Apparatus for selectively feeding sheets as specified in claim 1 further comprising:

a synchronized vacuum means mounted below the carrier belt sequenced to operate as the sheets contact the carrier belt to assist in advancing the sheets.

11. Apparatus for selectively feeding sheets as specified in claim 1 having:

a means to hold the lifter means in locked position.

12. Apparatus for selectively feeding sheets as specified in claim 11 wherein:

the means to hold the lifter means in position above the paper line comprises at least one slidable locking wedge engageable with the lifter means to support the lifter bar in locked position, thereby stopping the feed material from advancing through the feed gate.

13. Apparatus for selectively feeding sheets as specified in claim 1 having:

a means for selectively stopping and starting the lifter means.

14. Apparatus for selectively feeding sheets as specified in claim 13 wherein:

wherein the means for selectively stopping and starting the lifter bar means is a spring loaded turnbuckle operably connected to a locking wedge and wedge bar.

15. Apparatus for selectively feeding sheets as specified in claim 12 having a means for disengaging the wedge.

16. Apparatus for selectively feeding sheets as specified in claim 1 wherein:

the means to hold the lifter means in position comprises a slidable wedge bar being operably connected to an air cylinder and engageable connected to a slidable locking wedge.

* * * * *